US010392792B2

(12) United States Patent
Chua

(10) Patent No.: US 10,392,792 B2
(45) Date of Patent: Aug. 27, 2019

(54) METHOD OF PRIMING A DRAINAGE APPARATUS FOR SIPHONING LIQUID AND DRAINAGE APPARATUS

(71) Applicant: Boon Pen Chua, Singapore (SG)

(72) Inventor: Boon Pen Chua, Singapore (SG)

( * ) Notice: Subject to any disclaimer, the term of this patent is extended or adjusted under 35 U.S.C. 154(b) by 212 days.

(21) Appl. No.: 15/123,871

(22) PCT Filed: Mar. 3, 2015

(86) PCT No.: PCT/SG2015/000066
§ 371 (c)(1),
(2) Date: Sep. 6, 2016

(87) PCT Pub. No.: WO2015/137875
PCT Pub. Date: Sep. 17, 2015

(65) Prior Publication Data

US 2017/0175375 A1 Jun. 22, 2017

(30) Foreign Application Priority Data

Mar. 10, 2014 (SG) ..... 10201400510Q

(51) Int. Cl.
*E03F 5/10* (2006.01)
*E03F 5/20* (2006.01)
(Continued)

(52) U.S. Cl.
CPC ..... *E03F 5/20* (2013.01); *E03F 1/002* (2013.01); *E03F 5/10* (2013.01); *F04F 10/02* (2013.01);
(Continued)

(58) Field of Classification Search
CPC ... E03F 5/20; E03F 5/101; E03F 1/002; E03F 3/00; F04F 10/02; Y10T 137/2713–2924;
(Continued)

(56) References Cited

U.S. PATENT DOCUMENTS 117,750 A * 8/1871 deLagillardie ..... F04F 10/00 137/142
240,908 A * 5/1881 Keller ..... A01K 63/003 137/590.5
(Continued)

FOREIGN PATENT DOCUMENTS

CH 676264 A5 12/1990
DE 202009010600 U1 12/2009
(Continued)

OTHER PUBLICATIONS

International Search Report and Written Opinion; International Preliminary Report on Patentability.

*Primary Examiner* — Craig J Price
(74) *Attorney, Agent, or Firm* — Joseph G. Chu; JCIP

(57) ABSTRACT

A method 200 for priming a drainage apparatus 100 comprises directing liquid into the conduit arrangement at 202 via the liquid injection inlet **106*b*12 to fill up most of the conduit arrangement as controlled by the valves' configuration; directing liquid into the first reservoir 102 at 206 to enable more liquid to enter into the conduit arrangement via the first opening 112 and at 208, to flood the conduit arrangement to form a continuous liquid flow path which extends from the first opening 112 up to at least the second opening 114, the continuous liquid flow path creating a siphon; and with the first opening 112 kept below the liquid's surface level in the first reservoir 102, stopping the flow of liquid into the first reservoir 102 to achieve a state of equilibrium of the siphon at 210** to prime the conduit arrangement.

18 Claims, 9 Drawing Sheets

(51) Int. Cl.
*E03F 1/00* (2006.01)
*F04F 10/02* (2006.01)
*E03F 3/00* (2006.01)

(52) U.S. Cl.
CPC ..... *E03F 3/00* (2013.01); *E03F 5/101* (2013.01); *Y10T 137/2849* (2015.04)

(58) Field of Classification Search
CPC . Y10T 137/0318–053; Y10T 137/2842; Y10T 137/2849; Y10T 137/2911; Y10T 137/86075; Y10T 137/86187; Y10T 137/86196; Y10T 137/86212; Y10T 137/86324; Y10T 137/86332; Y10T 137/86348
USPC .. 137/123–153, 565.22, 571, 574, 587, 588, 137/590, 1–15.26; 210/170.03, 170.04, 210/170.09, 170.01; 405/36, 52, 53, 74, 405/107
See application file for complete search history.

(56) References Cited

U.S. PATENT DOCUMENTS 301,391 A * 7/1884 Reinecke ..... E03D 1/165 137/135
465,734 A * 12/1891 Singer ..... F04F 10/00 137/151
659,669 A * 10/1900 Haynes ..... F04F 10/00 137/142
665,826 A * 1/1901 Carroll ..... A23C 3/031 137/127
1,083,995 A * 1/1914 Davis et al. ..... E02B 8/06 137/124
2,617,440 A * 11/1952 Stephens ..... F04F 10/00 137/147
2,791,232 A * 5/1957 Downs ..... B67D 3/00 137/153
4,540,014 A * 9/1985 Baumberg ..... A01G 25/16 137/123
6,178,984 B1 * 1/2001 Amsellem ..... A01G 27/005 137/142
9,140,409 B2 * 9/2015 Kataoka ..... F02M 37/0023
2002/0043283 A1 * 4/2002 Bouwkamp ..... E02B 7/18 137/251.1

FOREIGN PATENT DOCUMENTS

FR 2839733 A1 11/2003
GB 2105411 A 3/1983
JP H1018394 A 1/1998
JP 5572682 B2 8/2014
WO 9114054 A1 9/1991
WO WO-2012095968 A1 * 7/2012 ..... F02M 37/0023

* cited by examiner

METHOD OF PRIMING A DRAINAGE APPARATUS FOR SIPHONING LIQUID AND DRAINAGE APPARATUS

FIELD & BACKGROUND

The present invention relates to a method of priming a drainage apparatus for siphoning liquid, and a drainage apparatus.

Due to global warming, changes in rainfall weather patterns have been seen in many parts of the world. Some regions experienced prolonged droughts, while others have had intense, sudden rainstorms which tend to cause flash floods. A flash flood can be defined as: "a flood that rises and falls quite rapidly with little or no advance warning, usually as a result of intense rainfall over a relatively small area". Despite the proliferation of modern technologies, societies are still vulnerable to flash floods, especially so as more and more cities are becoming megacities and economies are increasingly nurtured by urbanization. Thus when flash floods occur, they can claim the lives of many people, as well as cause widespread damage to property and infrastructure, incurring economic losses.

A conventional measure typically adopted to cope with flash flooding by building wider drainage canals has however not been effective due to the unpredictability of rainfall patterns brought about by global warming, in terms of the amount of rainfall forecasted to be deposited over a region.

One object of the present invention is therefore to address at least one of the problems of the prior art and/or to provide a choice that is useful in the art.

SUMMARY

According to a 1$^{st}$ aspect of the invention, there is provided a method of priming a drainage apparatus for siphoning liquid between first and second reservoirs. The apparatus includes a conduit arrangement having a first opening disposed in the first reservoir, a second opening disposed in the second reservoir and a liquid injection inlet arranged between the first and second openings, and at least one valve for controlling flow of the liquid along the conduit arrangement. The method comprises directing liquid into the conduit arrangement via the liquid injection inlet to fill up most of the conduit arrangement as controlled by the valve's configuration; directing liquid into the first reservoir to enable more liquid to enter into the conduit arrangement via the first opening and to flood the conduit arrangement to form a continuous liquid flow path which extends from the first opening up to at least the second opening, the continuous liquid flow path creating a siphon; and with the first opening kept below the liquid's surface level in the first reservoir, stopping the flow of liquid into the first reservoir to achieve a state of equilibrium of the siphon to prime the conduit arrangement. After the priming and in use, the siphon is triggered when more liquid is added into the first reservoir which causes the added liquid to be siphoned to the second reservoir via the primed conduit arrangement.

It is to be appreciated that in the above context, the state of equilibrium is defined as the hydrostatic pressure at both ends of the continuous liquid flow path is in equilibrium and the siphon halts until it is triggered.

Liquid is may include water (such as rainwater, drinking water, sea water, irrigation water etc) and oil etc.

Advantages of the proposed method may include allowing the drainage apparatus to be used for transferring/diverting of liquid from a source reservoir to a destination reservoir by using the siphoning effect, without requiring pumps to be installed. As long as the conduits of the drainage apparatus are filled with the liquid, the siphoning effect works automatically to transfer/divert the fluid, when the fluid pressures in the two reservoirs are not equalized. This benefit means minimal human monitoring and maintenance are required for operating the drainage apparatus.

The method of may include, prior to directing liquid into the first reservoir, further comprising releasing air trapped in the mostly filled conduit arrangement. The method may also include, prior to directing liquid into the conduit arrangement, further comprising configuring the at least one valve to enable the conduit arrangement to be mostly filled.

The conduit arrangement may include a plurality of conduits arranged in fluid communication, or it may also include a single integral conduit.

According to a 2$^{nd}$ aspect of the invention, there is provided a drainage apparatus for siphoning liquid between first and second reservoirs. The apparatus comprises a conduit arrangement having a first opening disposed in the first reservoir, a second opening disposed in the second reservoir and a liquid injection inlet arranged between the first and second openings for directing liquid into to fill up most of the conduit arrangement; and at least one valve for controlling flow of the liquid along the conduit arrangement; wherein prior to using the drainage apparatus for siphoning the liquid, the liquid injection inlet is configured to receive liquid to fill up most of the conduit arrangement as controlled by the valve's configuration; and wherein the first opening is configured to receive more liquid which has been directed into the first reservoir to flood the conduit arrangement to form a continuous liquid flow path which extends from the first opening up to at least the second opening, the continuous flow path configured to create a siphon which is at a state of equilibrium to prime the conduit arrangement when, the flow of liquid into the first reservoir is stopped and the first opening is kept below the liquid's surface level in the first reservoir; whereby after priming and in use, the siphon is triggered when more liquid is added into the first reservoir which causes the added liquid to be siphoned to the second reservoir via the primed conduit arrangement.

According to a 3$^{rd}$ aspect of the invention, there is provided a drainage apparatus adapted to siphon liquid between first and second reservoirs. The apparatus comprises first and second openings; a conduit arrangement; and at least one valve arranged along the conduit arrangement to control flow of the liquid in the conduit arrangement via the first and second openings. The first and/or second opening is configured to be at least twice the diameter of the conduit arrangement.

The first opening may be disposed in the first reservoir and arranged to face the floor of the first reservoir. The second opening may be disposed in the second reservoir and arranged to face the floor of the second reservoir.

The second opening may be disposed in the second reservoir and arranged to face away from the floor of the second reservoir.

There may be more than one valve and the valves include check valves and return valves. At least some of the valves may be configured to enable air trapped in the conduit arrangement to be released therefrom.

The conduit arrangement may include a plurality of conduits arranged in fluid communication, or the conduit arrangement may include a single integral conduit.

If the conduit arrangement has a plurality of conduits, the plurality of conduits may include first and second conduits respectively configured with the first and second openings, a portion of the first and second conduits being positioned at a same liquid level. The apparatus may further comprise a drainage conduit being arranged at the second reservoir. Preferably, the drainage conduit is disposed to be spaced apart from the outlet by approximately 300 mm. Other distances are possible, 200 mm, 400 mm, 500 mm etc.

The apparatus may include the first and second reservoirs the first and second reservoirs, in particular when a contractor is engaged to construct the reservoirs as well as to install the drainage apparatus.

Preferably, the second opening is configured to be at least three times, or four times the diameter of the conduit arrangement.

The conduit arrangement may include a transverse portion extending between the first and second reservoirs, the transverse portion having a series of undulations arranged therealong. This traverse portion may extend to great lengths depending on how far apart the two reservoirs are. As an example, the traverse portion may have a length of at least 1000 meters.

According to a $4^{th}$ aspect of the invention, there is provided a flood control system comprising the drainage apparatus based on the $2^{nd}$ or $3^{rd}$ aspect of the invention.

It should be apparent that features relating to one aspect of the invention may also be applicable to the other aspects of the invention.

These and other aspects of the invention will be apparent from and elucidated with reference to the embodiments described hereinafter.

BRIEF DESCRIPTION OF THE DRAWINGS

Embodiments of the invention are disclosed hereinafter with reference to the accompanying drawings, in which.

DETAILED DESCRIPTION OF PREFERRED EMBODIMENTS

Figure 1:
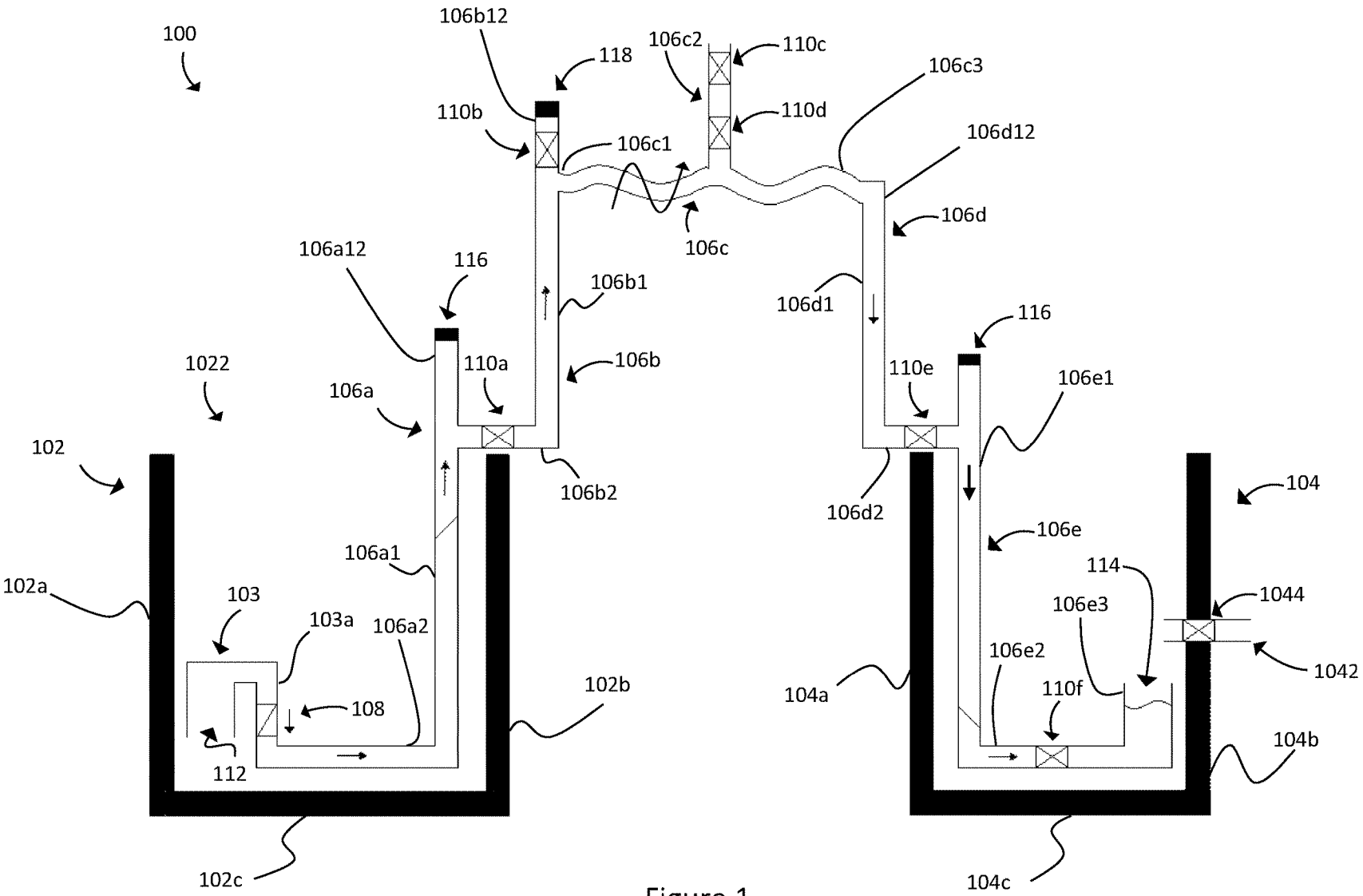
FIG. 1 shows a schematic of a drainage apparatus, according to a first embodiment.

FIG. 1 shows a schematic of a drainage apparatus 100 according to a first embodiment, which is adapted to siphon liquid between first and second reservoirs 102, 104. Each of the first and second reservoirs has walls 102*a*, 102*b*, 104*a*, 104*b*, and a floor 102*c*, 104*c*. The floors 102*c*, 104*c* of the first and second reservoirs 102, 104 are located on a same level. For clarity, the definition of the drainage apparatus 100 in this instance excludes the first and second reservoirs 102, 104. Examples of the first and second reservoirs 102, 104 include wells, drains, canals or the like, while the liquid includes water. In this instance, the first reservoir 102 defines a source from which the liquid is to be siphoned, and the second reservoir 104 defines a destination to which the siphoned liquid is to be discharged. Also, the first reservoir 102 has an opening 1022 from which the liquid can be received and collected into the first reservoir 102 (e.g. rainwater falling into the first reservoir 102 through the opening 1022). The second reservoir 104 may be sheltered, and has a drainage pipe 1042 (configured with a return valve 1044) located through one of the walls 104*b* for draining away excess liquid discharged into the second reservoir 104 to prevent overflowing thereof. The drainage pipe 1042 is coupled to other reservoirs which are not shown in FIG. 1 due to space constraints. It is to be appreciated that the drainage apparatus 100 may also be known as a "liquid transfusion and waterworks system". In the first embodiment, the drainage apparatus 100 is included as part of a flood control/anti-flooding system (not shown), that can be deployed to address flooding of drains or canals during occurrence of flash floods.

The drainage apparatus 100 includes a conduit arrangement, which comprises a plurality of conduits 106*a-e* arranged in fluid communication, and a plurality of valves 108, 110 arranged along in at least some of the conduits 106*a-e*. In this embodiment, the conduits are PVC pipes although other suitable materials may be used depending on the applications, for example metallic pipes. Also, although a plurality of valves 108,110 are described, this may not be so as long as there is at least one valve. An example of the conduits 106*a-e* is water pipes. It is to be appreciated that the plurality of conduits 106*a-e* are detachably coupled to enable convenient assembly and disassembly, if required (e.g. facilitate easy transportation). Also, in this instance, the plurality of conduits 106*a-e* includes a set of first to fifth conduit members 106*a-e* (with substantially uniform diameters) whilst the plurality of valves 108, 110 includes a check valve 108 and a set of six return valves 110*a-f*. For description brevity, the first to fifth conduit members 106*a-e* will be referred to as first to fifth conduits 106*a-e* below.

It is to be appreciated that the first conduit 106*a* includes an inlet 112 for the plurality of conduits 106*a-e* for siphoning the liquid, while the fifth conduit 106*e* includes an outlet 114 for the plurality of conduits 106*a-e* for discharging the siphoned liquid. The first conduit 106*a* is arranged to be positioned in the first reservoir 102, and is of generally L-shaped. The first conduit 106*a* includes an L-shaped portion having a vertical arm 106*a*1 and a horizontal arm 106*a*2 which is coupled orthogonally to the vertical arm 106*a*1. The vertical arm 106*a*1 of the L-shaped portion of the first conduit 106*a* rises above the walls 102*a*, 102*b* of the first reservoir 102, whilst an inverted U-shaped portion 103 extends from a free end of the horizontal arm 106*a*2 of the L-shaped portion of the first conduit 106*a*. The inverted U-shaped portion 103 is configured with the inlet 112 which acts as a liquid receiving point for the plurality of conduits 106*a-e*. The inverted U-shaped portion 103 has a vertical part 103*a* which is orthogonal to the horizontal arm 106*a*2 and this is important to prime the drainage apparatus 100 as will be apparent later. The inlet 112 is arranged to face the floor 102*c* of the first reservoir 102; in other words, the inlet 112 is in an inverted configuration which prevents air from being introduced into the plurality of conduits 106*a-e* during siphoning which can detrimentally disrupt the siphoning action itself. Further, the inlet 112 is also about at least two times the diameter of the first conduit 106*a*, as shown in FIG. 1 to reduce the possibility of air from entering first conduit 106*a*. It is also to be appreciated that the inlet 112 is located substantially near to the floor 102*c* of the first reservoir 102. In addition, the inverted U-shaped portion 103 includes the check valve 108, which permits flow liquid only in a direction from the inlet 112 to the outlet 114 of the plurality of conduits 106*a-e*. A free end 106*a*12 of the vertical arm 106*a*1 of the L-shaped portion of the first conduit 106*a* is releasably closed with an air release cap 116, which can be removed to enable any air trapped in the first conduit 106*a* (when filled with liquid) to be released. Also, the vertical arm 106*a*1 of the L-shaped portion of the first conduit 106*a* rising above the surrounding walls 102*a*, 102*b* of the first reservoir 102 is fluid communicably coupled to the second conduit 106*b*.

The second conduit 106*b* is largely similar in structure to the first conduit 106*a*, except that the inverted U-shaped portion 103 is omitted. The second conduit 106*b* includes an L-shaped portion having a vertical arm 106*b*1 and a horizontal arm 106*b*2 which is coupled orthogonally to the vertical arm 106*b*1. The horizontal and vertical arms 106*b*2, 106*b*1 of the L-shaped portion of the second conduit 106*b* are respectively configured with the first and second return valves 110*a*, 110*b*. The horizontal arm 106*b*2 of the L-shaped portion of the second conduit 106*b* is coupled to the vertical arm 106*a*1 of the L-shaped portion of the first conduit 106*a*. Further, the second return valve 110*b* is arranged in the vertical arm 106*b*1 of the L-shaped portion of the second conduit 106*b* at a position above where the second conduit 106 is fluid communicably coupled to a first end 106*c*1 of the third conduit 106*c*. Similarly, a free end 106*b*12 of the vertical arm 106*b*1 of the L-shaped portion of the second conduit 106*b* is releasably closed with a liquid insertion cap 118, which is removable for filling the plurality of conduits 106*a-e* with liquid. It is to be appreciated that the liquid insertion cap 118 is located proximal to the second return valve 110*b*.

The third conduit 106*c* is arranged transverse to the vertical arm 106*b*1 of the L-shaped portion of the second conduit 106*b*, and has a series of undulations along the length of the third conduit 106*c*. In particular, the third conduit 106*c* extends between the first and second reservoirs 102, 104. It should be appreciated that the third conduit 106*c* may extend a greater distance, for instance from meters to kilometers (e.g. at least 1000 meters) depending on a distance apart between the first and second reservoirs 102, 104. Also, substantially at the middle of the third conduit 106*c* is a rising vertical arm 106*c*2 configured with the third and fourth return valves 110*c*, 110*d*, which are arranged spaced apart. Preferably, the rising vertical arm 106*c*2 is located at a highest point of the drainage apparatus 100. The third return valve 110*c* is positioned above the fourth return valve 110*d*. The third return valve 110*c* is normally closed whereas the fourth return valve 110*d* is normally opened. During priming of the drainage apparatus which will be described below, these return valves 110*c*,110*d* enable air trapped within the conduits to be released. The vertical arm 106*c*2 may include a viewing window to check if there is air trapped below the third return valve 110*c* and if there is an air gap, the fourth return valve 110*d* is closed and the third return valve 110*c* is opened and liquid injected into the rising vertical arm 106*c*2 to displace the trapped air from the vertical arm 106*c*2. Thereafter, the third return valve 110*c* is closed and the fourth return valve 110*d* opened.

A second end 106*c*3, opposite to the first end 106*c*1, of the third conduit 106*c* is fluid communicably coupled to the fourth conduit 106*d*, which is in turn coupled to the fifth conduit 106*e*. The manner in which the fourth conduit 106*d* is coupled to the fifth conduit 106*e* is a mirror arrangement of how the second conduit 106*b* is coupled to the first conduit 106*a*, and hence not repeated for brevity sake. It is to be appreciated that the fourth conduit 106*d* is structurally similar to the second conduit 106*b* (and has the fifth return valve 110*e*), except that a free end 106*d*12 of the vertical arm 106*d*1 of the fourth conduit 106*d* is coupled to the second end 106*c*3 of the third conduit 106*c*. Particularly, the fourth conduit 106*d* includes an L-shaped portion having a vertical arm 106*d*1 and a horizontal arm 106*d*2 which is coupled orthogonally to the vertical arm 106*d*1.

The fifth conduit 106*e* is arranged to be positioned in the second reservoir 104, and is structurally similar to the first conduit 106*a*, except that the inverted U-shaped portion 103 is omitted, and replaced by an upward facing portion 106*e*3 and the fifth conduit 106*e* is also configured with the sixth return valve 110*f*, instead of the check valve 108. The fifth conduit 106*e* includes an L-shaped portion having a vertical arm 106*e*1 and a horizontal arm 106*e*2 which is coupled orthogonally to the vertical arm 106*e*1. The upward facing portion 106*e*3 is coupled orthogonal to the horizontal arm 106*e*2 and this angled arrangement is similar to the angled arrangement near the inlet 112 in the first reservoir 102 i.e. the arrangement between the vertical part 103*a* and the horizontal arm 106*a*2. Both of these arrangements are configured to prime the drainage apparatus 100 i.e. to achieve a state of equilibrium for the liquid in the drainage apparatus 100, as will be apparent later. The outlet 114 on the fifth conduit 106*e*, which acts as a liquid discharging point for the plurality of conduits 106*a-e*, is configured to face opposite to and away from the floor 104*c* of the second reservoir 104. Additionally, the outlet 114 is about at least two times the diameter of the fifth conduit 106*e* to prevent liquid from being sucked back into the fifth conduit 106*e* after being discharged therefrom, and to reduce the possibility of introducing air bubbles into the fifth conduit 106*e*. Further, the drainage pipe 1042 is disposed at least 300 mm above the outlet 114. Like the inlet 112, the outlet 114 is located substantially near to the floor 104*c* of the second reservoir 104. It is also to be appreciated that the drainage pipe 1042 of the second reservoir 104 is positioned at a higher liquid level (in the second reservoir 104) than where the outlet 114 is positioned. It is further to be appreciated that the horizontal arm 106*a*2 of the L-shaped portion of the first conduit 106*a* and the horizontal arm 106*e*2 of the L-shaped portion of the fifth conduit 106*e* are respectively positioned in the first and second reservoirs 102, 104 at a same liquid level.

Figure 2:
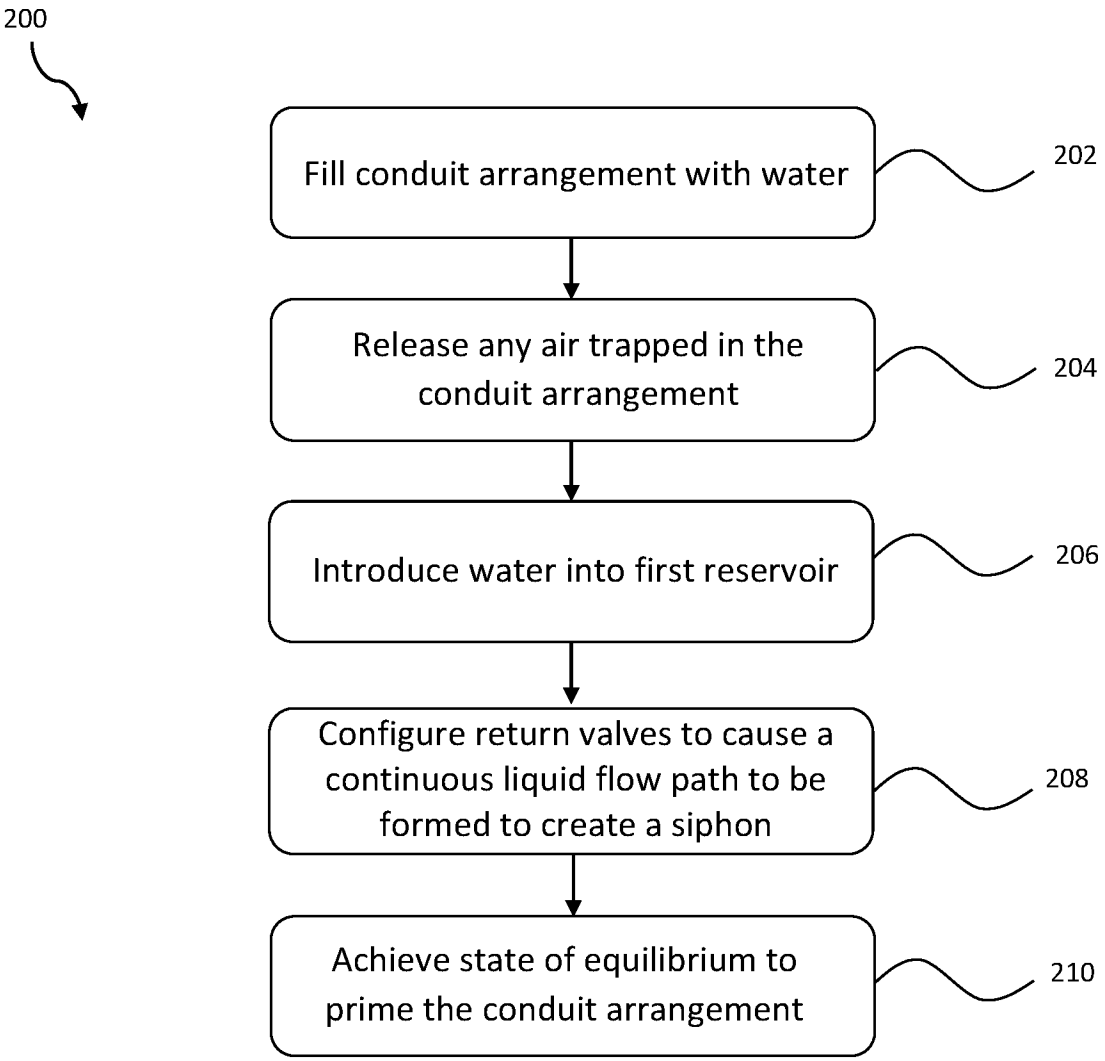
FIG. 2 shows a flow diagram for a method of priming the drainage apparatus of FIG. 1.

FIG. 2 shows a flow diagram for a method 200 of deploying the drainage apparatus of FIG. 1. Water is used as an example of the liquid in the description of this method 200. Prior to executing the method 200, the first and second reservoirs 102, 104 are initially empty, and the plurality of conduits 106*a-e* is also empty. In addition, the six return valves 110*a-f* are initially configured as closed.

The method 200 begins at step 202, where the first, second and fifth return valves 110*a*, 110*b*, 110*e* are opened to enable water to be introduced into the plurality of conduits 106*a-e* through the free end 106*b*12 covered by the liquid insertion cap 118 to mostly fill the plurality of conduits 106*a-e* with the water. Thus, the liquid insertion cap 118 is to be removed for the plurality of conduits 106*a-e* to be filled. The liquid insertion cap 118 is screwed back once the plurality of conduits 106*a-e* is filled. This step 202 is also known as "priming", as filling up the plurality of conduits 106*a-e* creates hydrostatic pressure therewithin to subsequently enable siphoning of the water from the first reservoir 102 to the second reservoir 104. Once step 202 is completed, the air release caps 116 are removed to enable any air trapped (as bubbles) in the water, during filing the plurality of conduits 106*a-e*, to be released, in a step 204. Needless to say, the air release caps 116 are screwed back on once the trapped air bubbles are released.

Figure 3:
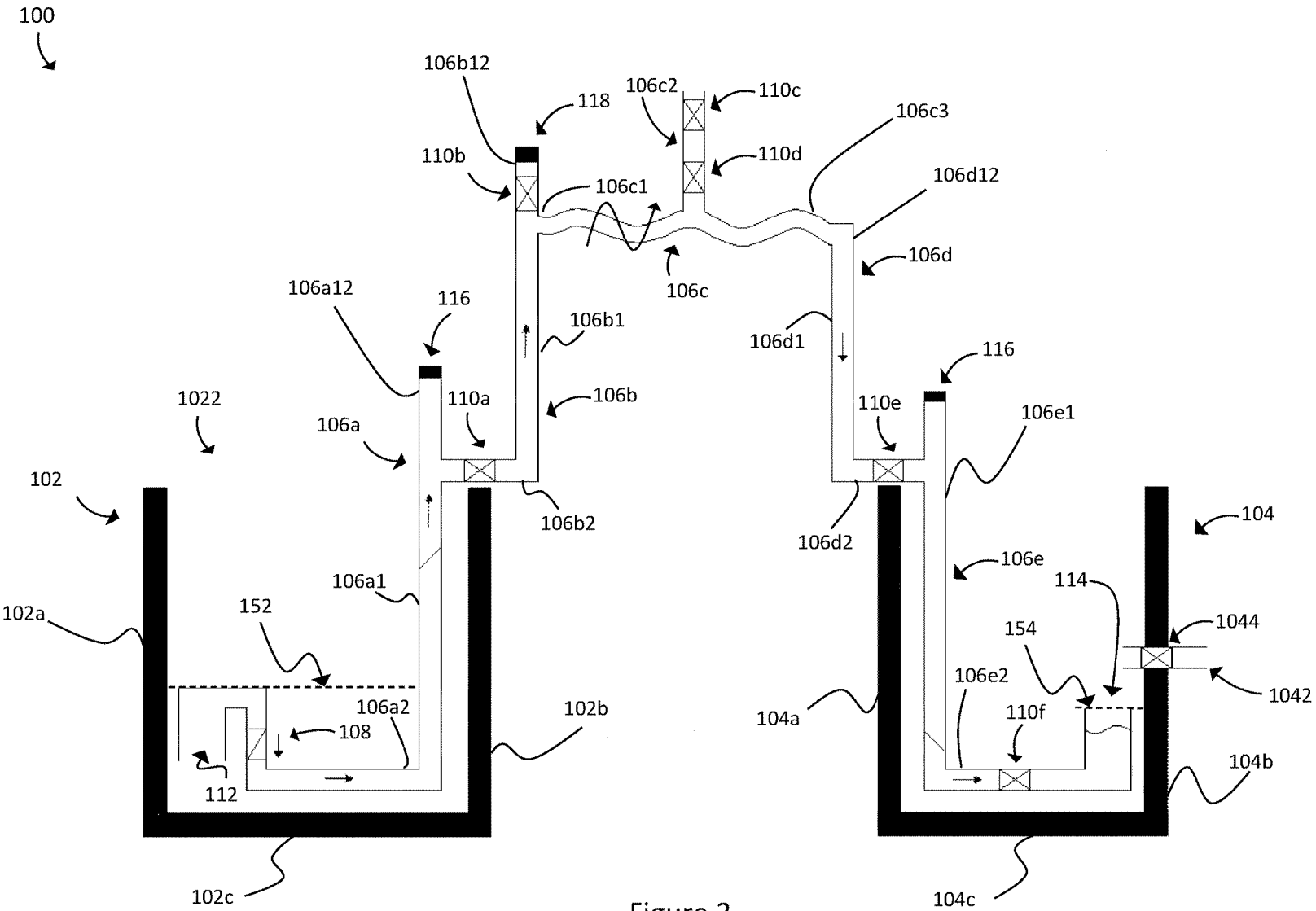
FIG. 3 shows a schematic of the drainage apparatus of FIG. 1, subsequent to performance of the method shown in FIG. 2.

In a next step 206, more water is introduced into the first reservoir 102, which consequently provides sufficient fluid pressure to cause the water to flow into the inlet 112, pass the check valve 108 and mix with the water filled in the plurality of conduits 106*a-e*. In a further step 208, the sixth return valve 110*f* is opened. Due to the continued provision of water (and thus increased fluid pressure) in the first reservoir 102, the water is then caused to move through the plurality of conduits 106*a-e* and discharges via the outlet 114 into the second reservoir 104 by way of the siphoning action. That is, a continuous liquid flow path which extends from the inlet 112 to at least the outlet 114 is formed, and the continuous liquid flow path creates a siphon. The provision of the water at the first reservoir 102 is stopped when a level of the water collected in the first and second reservoirs 102, 104 equalizes, i.e. a state of equilibrium of the siphon is achieved as per step 210, where the plurality of conduits 106*a-e* is then considered primed. It is to be appreciated that the state of equilibrium is defined as the hydrostatic pressure at both ends of the continuous liquid flow path is in equilibrium and the siphon halts until triggered. This state of equilibrium in the context of the schematic of the drainage apparatus 100 is depicted in FIG. 3. It is to be appreciated that the level 152 of the water in the first reservoir 102 covers and submerges the inlet 112, while in the second reservoir 104, the level 154 of water fills up at least to the brim of the outlet 114. In other instances where a level of water in the second reservoir 104 however covers and submerges the outlet 114, this level of the water collected is below the position of the drainage pipe 1042, as will be appreciated. The drainage pipe 1042 is disposed at least 300 mm above the outlet 114. Once the method 200 is executed, the drainage apparatus 100 is considered operational for the purpose of transferring/diverting any further excess water that subsequently collects in the first reservoir 102 to the second reservoir 104 to prevent overflowing or flooding at the first reservoir 102.

In use, the drainage apparatus 100 may be deployed as part of the flood control/anti-flooding system and the first reservoir 102 is located at a vicinity which is prone to flooding, whereas the second reservoir 104 is arranged at a distance (e.g. may be a few kilometers away) away from the first reservoir 102.

An example scenario for usage of the drainage apparatus 100 (after being deployed using the method 200) is briefly described here to illustrate its operation. When a heavy storm occurs, large amounts of rainfall water are collected in the first reservoir 102 and with the drainage apparatus 100 being already setup for operation, the large amounts of rainfall water are therefore diverted from the first reservoir 102 to the second reservoir 104 by being siphoned through the plurality of conduits 106*a-e*. It is to be appreciated that the second reservoir 104 will not be filled because any excess rainfall water diverted to the second reservoir 104 is also drained away via the drainage pipe 1042 (to other reservoirs), once the water level in the second reservoir 104 rises to at where the drainage pipe 1042 is located. Once the storm has stopped, conditions in the first and second reservoirs 102, 104 then return to a state, whereby both water levels in the first and second reservoirs 102, 104 are substantially at the same level. So in this way, using the drainage apparatus beneficially prevents overflowing or flooding at the first reservoir 102.

Arranging the horizontal arm 106*a*2 of the L-shaped portion of the first conduit 106*a* and the horizontal arm 106*e*2 of the L-shaped portion of the fifth conduit 106*e* at the same liquid level has an advantage of creating a drainage apparatus which automatically starts the transfer of the liquid or stops the liquid transfer depending on the amount of water in the first reservoir 102. When there is no water being channelled into the first reservoir 102, the siphoning action will stop when the level of the water collected in the first and second reservoirs 102, 104 equalizes, i.e. a state of equilibrium of the siphon is achieved as per step 210 as explained above. In this way, this ensures that there is always liquid within the drainage apparatus to prime the drainage apparatus. When water starts to flow into the first reservoir again (for example, when rain starts to fall again), the siphon is triggered and the water transfer re-starts.

If the horizontal arm 106*e*2 of the fifth conduit 106*e* is arranged lower than the horizontal arm 106*a*2 of the first conduit 106*a*, this water transfer would be continuous until the water in the drainage apparatus is drained out. In other words, if no water is being directed into the first reservoir, the siphoning action would continue to discharge the liquid within the drainage apparatus that is needed for the priming of the apparatus and this is not ideal as this will require the drainage apparatus to be primed again.

Further embodiments of the invention will be described hereinafter. For sake of brevity, description of like elements, functionalities and operations that are common between the embodiments are not repeated; reference will instead be made to similar parts of the relevant embodiment(s).

Figure 4:
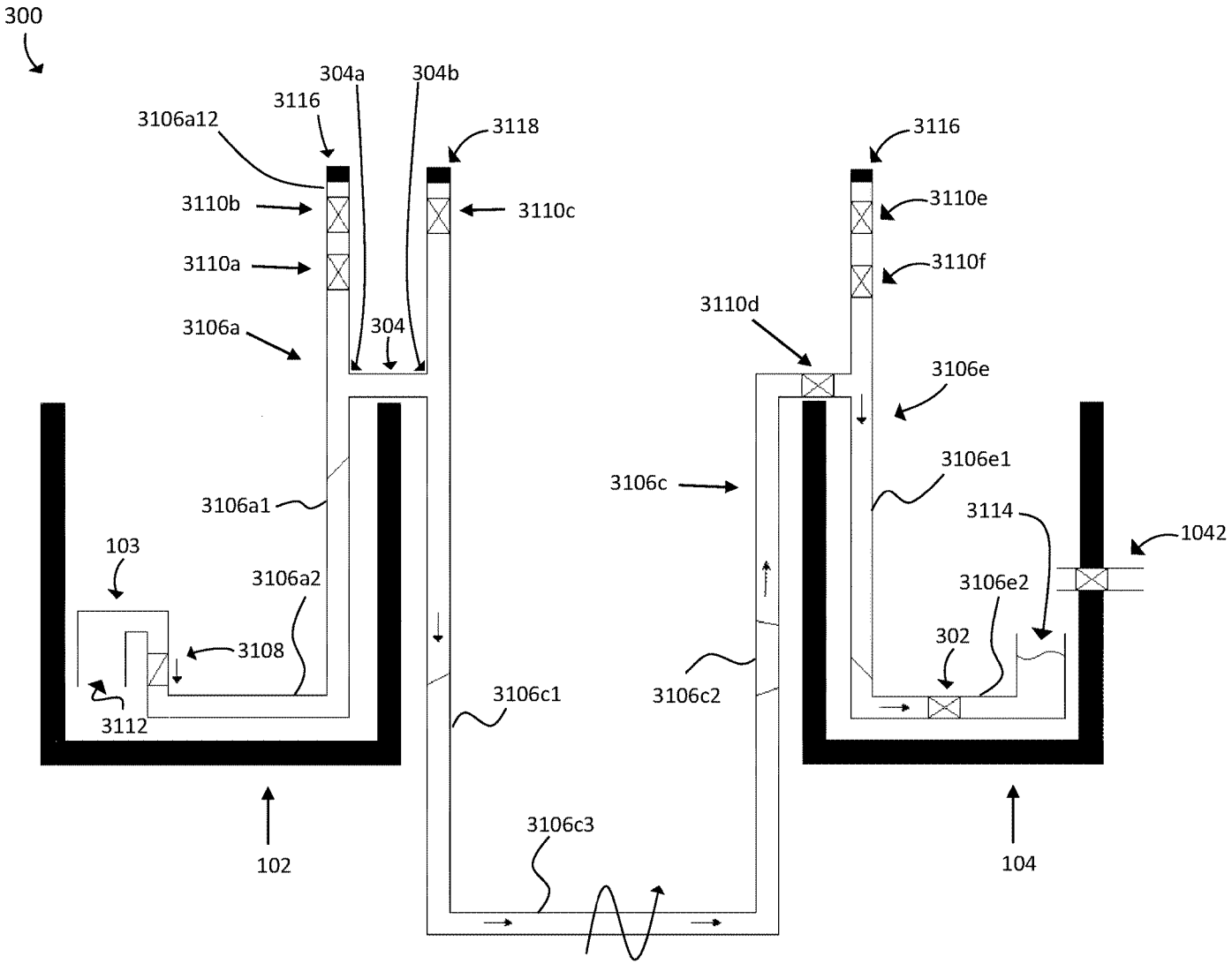
FIG. 4 shows a schematic of another drainage apparatus, according to a second embodiment.

According to a second embodiment, there is proposed another drainage apparatus 300 shown in FIG. 4. The second and fourth conduits 106*b*, 106*d* described in the first embodiment are omitted in this embodiment. Further differences between this drainage apparatus 300 and the drainage apparatus 100 of FIG. 1 are as follow. It is also highlighted that components of the drainage apparatus 300 of FIG. 4 similar to those in the drainage apparatus 100 of FIG. 1 follow similar reference numerals, but with 3000 added as reference numeral. There are seven return valves 3110*a-f*, 302 in the drainage apparatus 300 of FIG. 4, and the positions of the first six return valves 3110*a-f* have been re-arranged compared to in the first embodiment. The first conduit 3106*a* further includes first and second return valves 3110*a*, 3110*b* arranged in the vertical arm 3106*a*1 of the L-shaped portion of the first conduit 3106*a*, between the free end 3106*a*12 of the vertical, arm 3106*a*1 of the L-shaped portion and a point of the L-shaped portion where the first conduit 3106*a* is coupled to a connecting conduit 304. Specifically, the connecting conduit 304 is a plain transverse member and does not include any return valves or the liquid insertion cap 3118, and is coupled at one end 304*a* to the first conduit 3106*a*, and at an opposite end 304*b* to the third conduit 3106*c*. It is to be appreciated that the connecting conduit 304 is arranged to be positioned above the walls 102*a*, 102*b* of the first reservoir 102. As opposed to in the first embodiment, the third conduit 3106*c* is now arranged to be of generally U-shaped. Specifically, the third conduit 3106*c* includes a U-shaped portion having a left (vertical) arm 3106*c*1, a right (vertical) arm 3106*c*2 and a horizontal arm 3106*c*3 which is coupled orthogonally to the left and right arms 3106*c*1, 3106*c*2 at their base. The liquid insertion cap 3118 is included at the left arm 3106*c*1 of the U-shaped portion of the third conduit 3106*c*, which is coupled to the connecting conduit 304. The third return valve 3110*c* is arranged proximal to the liquid insertion cap 3118. The right arm 3106*c*2 of the U-shaped portion of the third conduit

3106*c* is bent at a free end and coupled to the fifth conduit 3106*e*; and the bent portion of the right arm 3106*c*2 includes the fourth return valve 3110*d*. A horizontal arm 3106*c*3 of the U-shaped portion of the third conduit 3106*c*, connecting the left and right arms 3106*c*1, 3106*c*2, is arranged to be positioned at a level below the floors 102*c*, 104*c* of the first and second reservoirs 102, 104. Further, it is to be appreciated that the bent portion of the right arm 3106*c*2 is located above the walls 104*a*, 104*b* of the second reservoir 104, similar to the connecting conduit 304. The fifth conduit 3106*e* now includes the fifth and sixth return valves 3110*e*, 3110*f* in the vertical arm 3106*e*1 of the L-shaped portion of the fifth conduit 3106*e*, while also including the seventh return valve 302 in the horizontal arm 3106*e*2 of the L-shaped portion of the fifth conduit 3106*e*. The fifth return valve 3110*e* is located above the sixth return valve 3110*f*.

Figure 5:
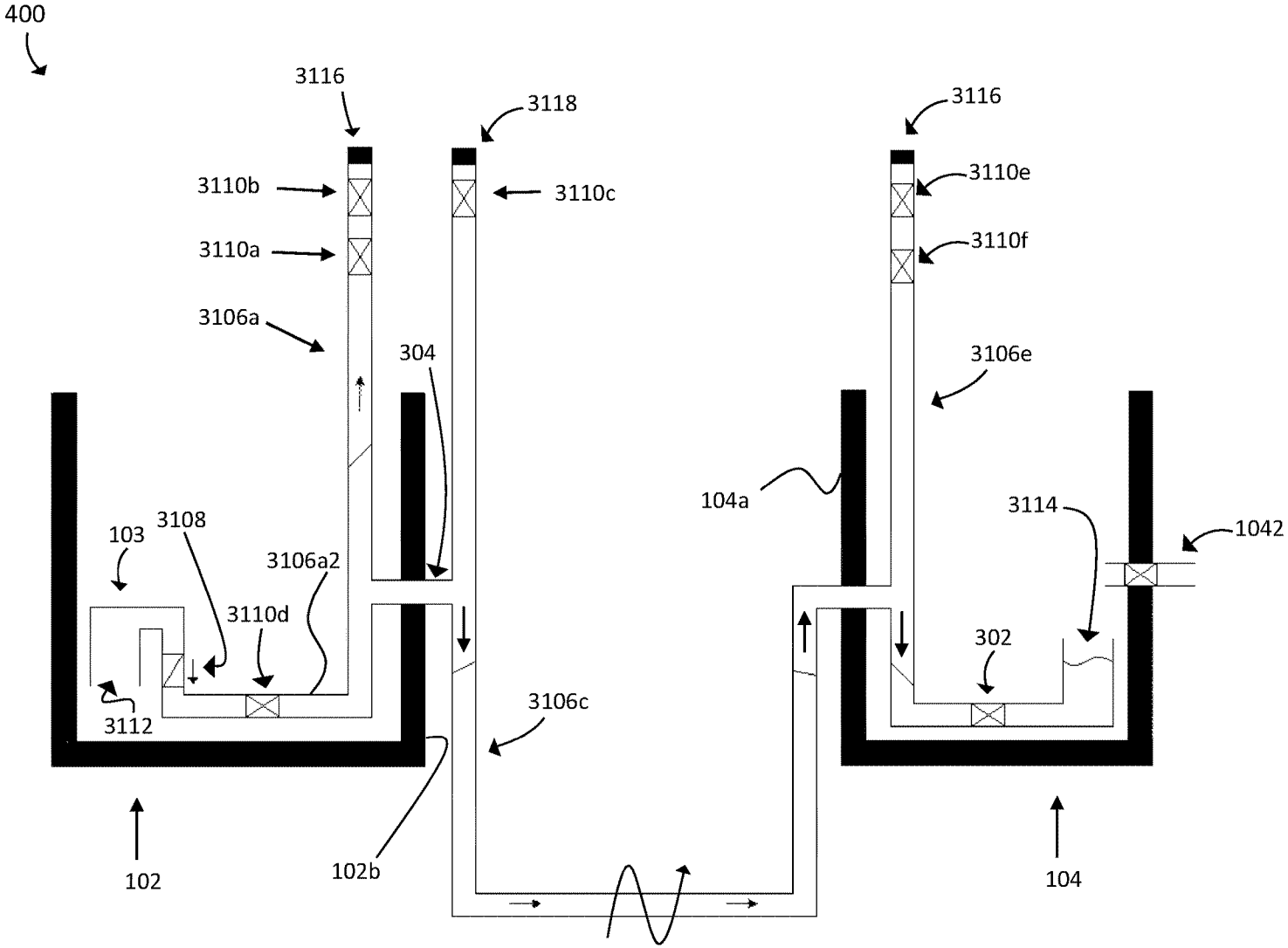
FIG. 5 shows a schematic of a further drainage apparatus, according to a third embodiment.

According to a third embodiment, an alternative drainage apparatus 400 is proposed as per FIG. 5, which is largely similar to the drainage apparatus 300 of FIG. 4, but with minor differences. It is highlighted that like components of the drainage apparatus 400 of FIG. 5 are similarly labelled as those of the drainage apparatus 300 of FIG. 4. In particular, for the third embodiment, the connecting conduit 304 couples to the first and third conduits 3106*a*, 3106*c* at a much lower vertical position such that the connecting conduit 304 is now arranged to pass through the wall 102*b* of the first reservoir 102. This is also similarly the case for the bent portion of the right arm 3106*c*2 of the U-shaped portion of the third conduit 3106*c*, which is now arranged to pass through the wall 104*a* of the second reservoir 104 to be coupled to the fifth conduit 3106*e*. In addition, unlike in FIG. 4, the fourth return valve 3110*d* is now arranged to be positioned in the horizontal arm 3106*a*2 of the L-shaped portion of the first conduit 3106*a*.

Figure 6:
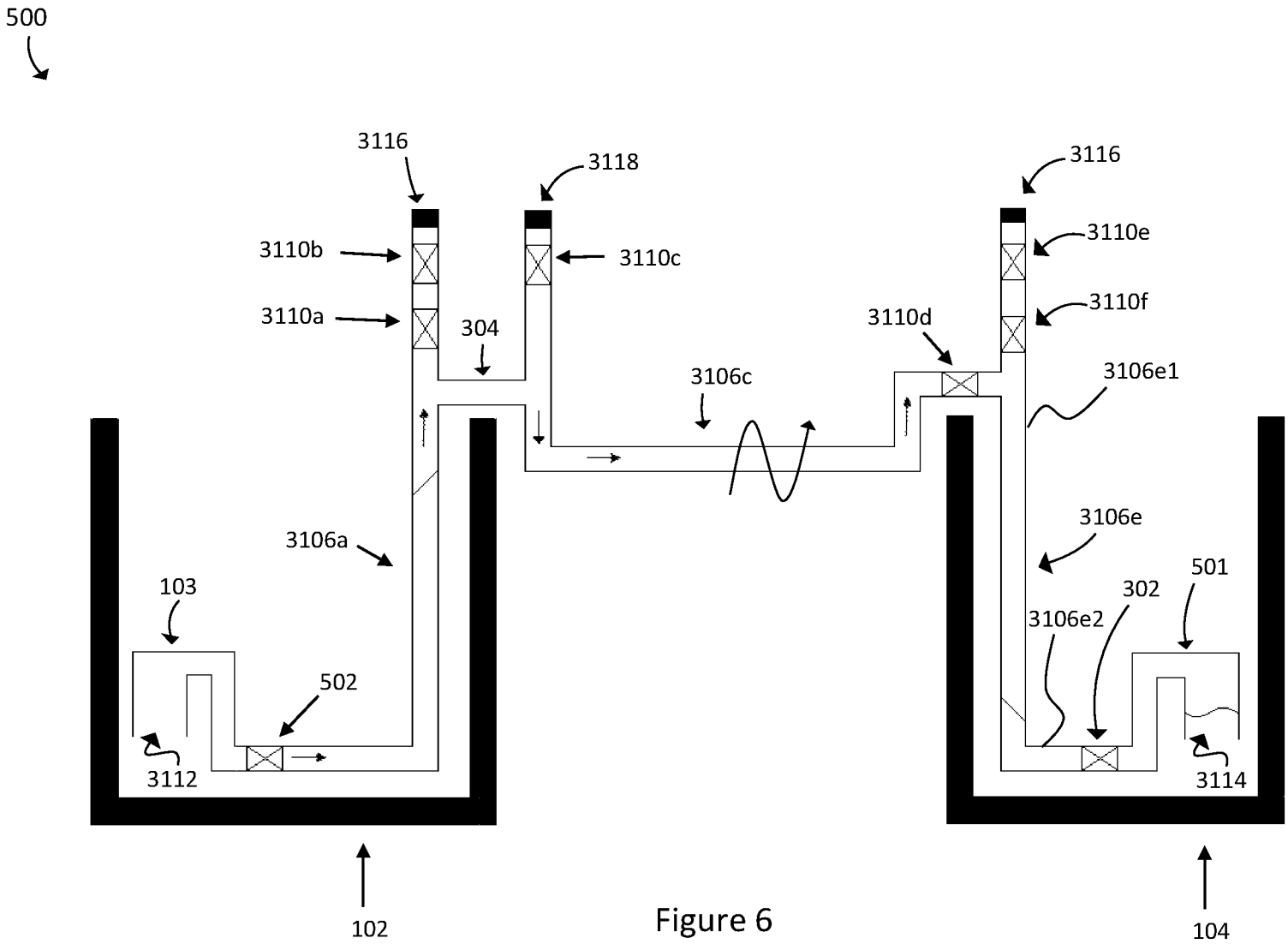
FIG. 6 shows a schematic of yet another drainage apparatus, according to a fourth embodiment.

According to a fourth embodiment, yet a further variant drainage apparatus 500 is shown in FIG. 6, which is largely similar to the drainage apparatus 300 of FIG. 4, but with minor differences. So for referencing convenience, like components of the drainage apparatus 500 of FIG. 5 are similarly labelled as those of the drainage apparatus 300 of FIG. 3. For the fourth embodiment, the horizontal arm 3106*c*3 of the U-shaped of the third conduit 3106*c*, connecting the left and right arms 3106*c*1, 3106*c*2, is now arranged to be positioned at a level below the height of the walls 102*a*, 102*b*, 104*a*, 104*b* of, but above the floors 102*c*, 104*c* of the first and second reservoirs 102, 104. In addition, the fifth conduit 3106*e* is now also configured with an inverted U-shaped portion 501 which extends from the free end of the horizontal arm 3106*e*2 of the L-shaped portion of the fifth conduit 3106*e*, similar to how the first conduit 106*a* is arranged in the first embodiment. Of course, this inverted U-shaped portion 501 is configured with the outlet 3114. Further, the check valve 3108 is omitted and replaced by an eighth return valve 502, which is arranged to be in the horizontal arm 3106*a*2 of the L-shaped portion of the first conduit 3106*a*. Also, this embodiment is configured such that liquid can be transferred/diverted from the first reservoir 102 to the second reservoir 104, or vice versa, improving the versatility of the drainage apparatus 500 of this embodiment. It is to be appreciated that the drainage pipe 1042 of the second reservoir 104 is omitted during to the said improved capability of the drainage apparatus 500.

Figure 7:
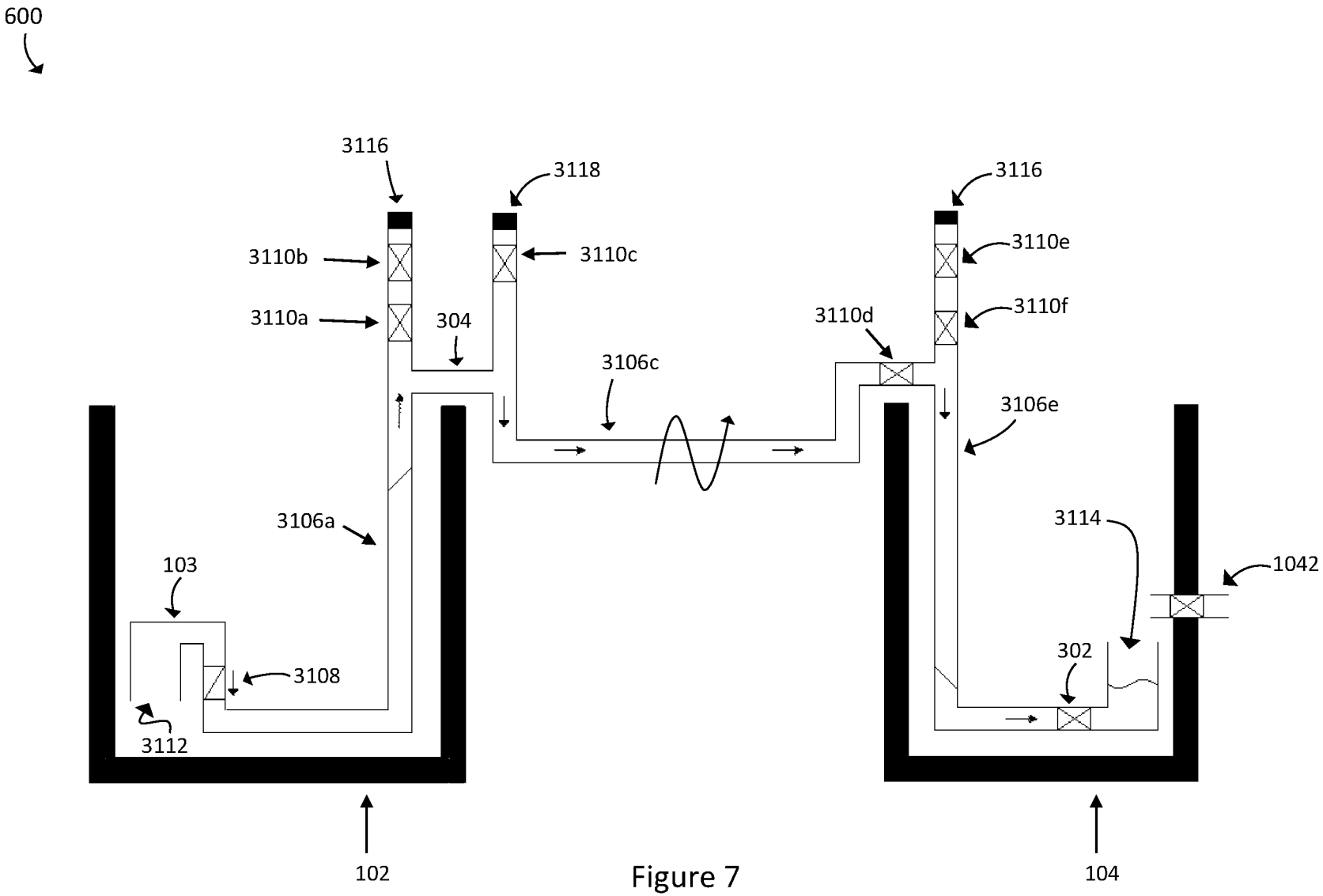
FIG. 7 shows a schematic of an alternative drainage apparatus, according to a fifth embodiment.

According to a fifth embodiment, another alternative drainage apparatus 600 is shown in FIG. 7, which is largely similar to the drainage apparatus 500 of FIG. 6, except that the inverted U-shaped portion 501 of the fifth conduit 3106*e* is now omitted, and the outlet 3114 is positioned in the same manner as described in the first embodiment. In addition, the eighth return valve 502 is omitted, and replaced with the check valve 3108, similar to the arrangement in the first embodiment.

Figure 8:
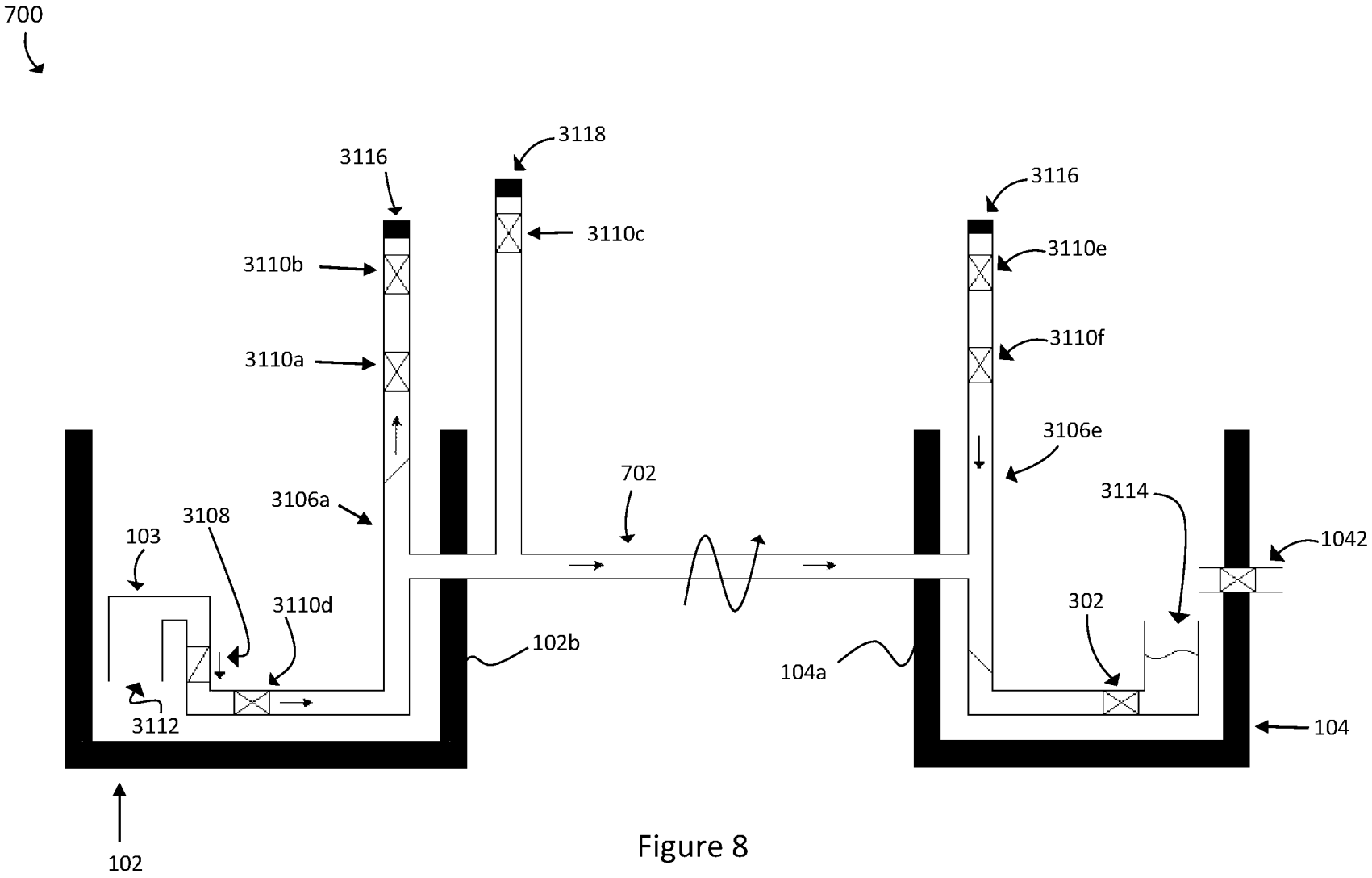
FIG. 8 shows a schematic of yet a further drainage apparatus, according to a sixth embodiment.

According to a sixth embodiment, a variant drainage apparatus 700 is shown in FIG. 8, which is largely similar to the drainage apparatus 400 of FIG. 5. The only difference is that the horizontal arm 3106*c*3 of the U-shaped portion of the third conduit 3106*c* is now arranged to be positioned on a same level as both the connecting conduit 304 and the bent portion of the right arm 3106*c*2 of the U-shaped portion of the third conduit 3106*c*. That is, the horizontal arm 3106*c*3 of the U-shaped portion of the third conduit 3106*c* (as in the third embodiment), the connecting conduit 304 and the bent portion of the right arm 3106*c*2 of the third conduit 3106*c* together forms a straight transverse member, which is labelled collectively in this sixth embodiment with reference numeral 702.

Figure 9:
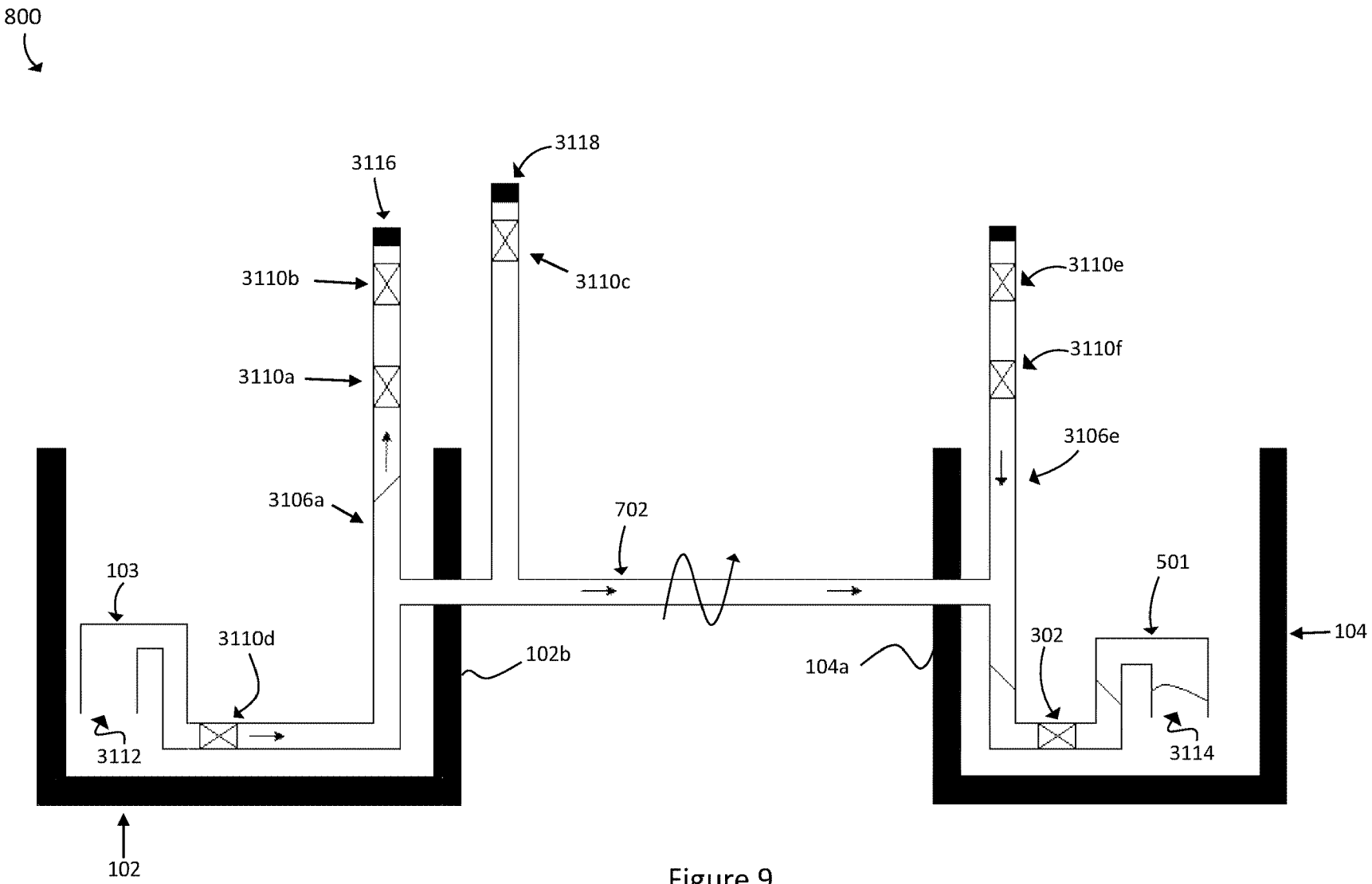
FIG. 9 shows a schematic of a drainage apparatus, according to a seventh embodiment.

According to a seventh embodiment, a further drainage apparatus 800 is proposed and shown in FIG. 9, which is similar to the drainage apparatus 700 of FIG. 8, except that the outlet 3114 arrangement follows the configuration (using the inverted U-shaped portion 501) as described per the drainage apparatus 500 of FIG. 6. It is also to be appreciated that the drainage pipe 1042 of the second reservoir 104, and the check valve 3108 are omitted in the seventh embodiment. The seventh embodiment is particularly configured such that liquid can be transferred/diverted from the first reservoir 102 to the second reservoir 104, or vice versa. Thus the versatility of the said drainage apparatus 800 is improved.

It is to be appreciated that the method 200 of FIG. 2 is applicable to all of the second to seventh embodiments as described above.

The proposed drainage apparatus 100, 300-800 discussed in afore embodiments advantageously enables transferring/diverting of liquid from a source reservoir to a destination reservoir by way of siphoning, without requiring usage of any pump or any moving part, thus saving costs. In addition, as long as the conduits of the drainage apparatus 100, 300-800 are filled with the liquid, the siphoning action will work to automatically divert the liquid, when the fluid pressure in the two reservoirs are not equalized. This means minimal human monitoring and maintenance are required for operation of the drainage apparatus 100, 300-800. Therefore, the drainage apparatus 100, 300-800 beneficially helps to prevent overflowing and flooding at the source reservoir (which may be a monsoon drain for example). Further, the drainage apparatus 100,300-800 may be used to channel water from a water storage facility to a water treatment facility.

The described embodiments should not however be construed as limitative. For example, the number of the return valves or check valves used is not limited as described above; any number of the return valves or check valves may be used, depending on the requirements of an application. This applies similarly to the number of conduits to be used, and is not limited to those described in the foregoing embodiments. Further the valves may be automatically (instead of manually) configured. In addition, the plurality of conduits 106*a-e* need not be of uniform diameters; each conduit may have a different diameter. Moreover, other suitable types of arrangements of the conduits are possible so long the siphoning effect is deployed and maintained to enable liquid transfer between the first and second reservoirs 102, 104. Furthermore, the drainage apparatus 100, 300-800 may also include the first and second reservoirs 102, 104.

Additionally, the second reservoir 104 may be deeper than the first reservoir 102. Also, the inlet 112 and outlet 114 may be arranged to be three times or four times the diameter of the conduit arrangement. The conduit arrangement may also be a single integral conduit, rather than a plurality of conduits 106*a-e*. It has been found that the greater the depth of the first and second reservoirs 102,104, the stronger is the siphoning action. Thus, the depth of the first and second reservoirs may be planned depending on the expected rate by which water needs to be transferred from the first reservoir to the second reservoir or vice versa. Although the embodiments described having a plurality of valves, which is preferred, but it should be mentioned that only one valve may be required.

While the embodiments describe only two reservoirs but it should be appreciated that a number of reservoirs may be "cascaded" together to form a network of reservoirs with first reservoir transferring water to a second reservoir, and water is transferred from the second reservoir to a third reservoir and so on and so forth.

Indeed, the flexibility of the drainage apparatus to be used in all sorts of imaginable terrain. For example, the embodiment of FIG. 4 or 5 allows the pipe 316*c*3 to be buried underground or under water (such as beneath the ocean bed) to perform the water transfer.

While the invention has been illustrated and described in detail in the drawings and foregoing description, such illustration and description are to be considered illustrative or exemplary, and not restrictive; the invention is not limited to the disclosed embodiments. Other variations to the disclosed embodiments can be understood and effected by those skilled in the art in practising the claimed invention.

The invention claimed is:

1. A method of priming a drainage apparatus for siphoning liquid between first and second reservoirs having respective reservoir floors, the apparatus including a conduit arrangement having a first opening disposed in the first reservoir, a second opening disposed in the second reservoir and a liquid injection inlet arranged between the first and second openings, and at least one valve for controlling flow of the liquid along the conduit arrangement, wherein the conduit arrangement further includes a first arm positioned along the first reservoir's floor and in direct fluid communication with the first opening, a second arm positioned along the second reservoir's floor and in direct fluid communication with the second opening, the first and second arms being positioned at a same liquid level, the method comprising:

directing liquid into the conduit arrangement via the liquid injection inlet to fill up most of the conduit arrangement as controlled by the at least one valve;

directing liquid into the first reservoir via the first opening to enable more liquid to enter into the conduit arrangement until a continuous liquid flow path is formed which extends from the first opening, the first arm, the second arm and up to at least the second opening and the first opening is kept below the liquid's surface level in the first reservoir and the liquid levels in the first arm and the second arm are at the same level, the continuous liquid flow path creating a siphon and a state of equilibrium of the siphon between the first and second openings is achieved to prime the conduit arrangement;

whereby after the priming and in use, the siphon is triggered automatically when more liquid is added into the first reservoir which causes the added liquid to be siphoned to the second reservoir via the primed conduit arrangement.

2. The method of claim 1, wherein prior to directing liquid into the first reservoir, further comprising releasing air trapped in the mostly filled conduit arrangement.

3. The method of claim 1, wherein prior to directing liquid into the conduit arrangement, further comprising configuring the at least one valve to enable the conduit arrangement to be mostly filled.

4. The method of claim 1, wherein the drainage apparatus further comprises an inverted U-shaped portion coupled orthogonally to the first arm, wherein the first opening is disposed at an end of the inverted U-shaped portion, in the first reservoir and arranged to face the floor of the first reservoir.

5. The method of claim 1, wherein the drainage apparatus further comprises an upward facing portion coupled orthogonally to the second arm, wherein the second opening is disposed at an end of the upward facing portion, in the second reservoir and arranged to face away from the floor of the second reservoir.

6. A drainage apparatus for siphoning liquid between first and second reservoirs having respective reservoir floors, the apparatus comprising:

a conduit arrangement having a first opening disposed in the first reservoir, a second opening disposed in the second reservoir and a liquid injection inlet arranged between the first and second openings for directing liquid into and to fill up most of the conduit arrangement; wherein the conduit arrangement further includes a first arm positioned along the first reservoir's floor and in direct fluid communication with the first opening, a second arm positioned along the second reservoir's floor and in direct fluid communication with the second opening, the first and second arms being positioned at a same liquid level; and at least one valve for controlling flow of the liquid along the conduit arrangement;

wherein prior to using the drainage apparatus for siphoning the liquid, the liquid injection inlet is configured to receive liquid to fill up most of the conduit arrangement as controlled by the valve;

wherein the first opening is configured to receive more liquid which has been directed into the first reservoir until a continuous liquid flow path is formed which extends from the first opening, the first arm, the second arm and up to at least the second opening, the continuous flow path configured to create a siphon which is at a state of equilibrium to prime the conduit arrangement and the first opening is kept below the liquid's surface level in the first reservoir with the liquid levels in the first arm and the second arm configured to be at the same level; and wherein the drainage apparatus further comprises an inverted U-shaped portion coupled orthogonally to the first arm, wherein the first opening is disposed at an end of the inverted U-shaped portion in the first reservoir and arranged to face the floor of the first reservoir;

whereby after priming and in use, the siphon is triggered automatically when more liquid is added into the first reservoir which causes the added liquid to be siphoned to the second reservoir via the primed conduit arrangement.

7. A flood control system comprising the drainage apparatus of claim 6.

8. A drainage apparatus adapted to siphon liquid between first and second reservoirs having respective reservoir floors, the apparatus comprising:

first and second openings;

a conduit arrangement configured to be filled with the liquid; and at least one valve arranged along the conduit arrangement to control flow of the liquid in the conduit arrangement via the first and second openings, wherein at least one of the first and second openings is configured to be at least twice a diameter of the conduit arrangement; and wherein the conduit arrangement includes a first arm positioned along the first reservoir's floor and in direct fluid communication with the first opening, a second arm positioned along the second reservoir's floor and in direct fluid communication with the second opening, wherein the first and second arms are disposed at a same liquid level; and wherein the drainage apparatus further comprises an inverted U-shaped portion coupled orthogonally to the first arm, wherein the first opening is disposed at an end of the inverted U-shaped portion, in the first reservoir and arranged to face the floor of the first reservoir;

whereby after priming the conduit arrangement and in use, siphon is triggered automatically when more liquid is added into the first or second reservoir.

9. The apparatus of claim 8, further comprising an inverted U-shaped portion coupled orthogonally to the second arm, wherein the second opening is disposed at an end of the inverted U-shaped portion, in the second reservoir and arranged to face the floor of the second reservoir.

10. The apparatus of claim 8, an upward facing portion coupled orthogonally to the second arm, wherein the second opening is disposed at an end of the upward facing portion, in the second reservoir and arranged to face away from the floor of the second reservoir.

11. The apparatus of claim 8, wherein there are more than one valve and the more than one valve include check valves and return valves.

12. The apparatus of claim 11, wherein at least some of the valves are further configured to enable air trapped in the conduit arrangement to be released.

13. The apparatus of claim 8, further comprising a drainage conduit being arranged at the second reservoir.

14. The apparatus of claim 13, wherein the drainage conduit is disposed to be spaced apart from the second opening by approximately 300 mm.

15. The apparatus of claim 8, wherein the second opening is configured to be at least three times the diameter of the conduit arrangement.

16. The apparatus of claim 8, wherein the second opening is configured to be at least four times the diameter of the conduit arrangement.

17. The apparatus of claim 8, wherein the conduit arrangement includes a transverse portion extending between the first and second reservoirs, the transverse portion having a series of undulations.

18. The apparatus of claim 17, wherein the transverse portion has a length of at least 1000 meters.

* * * * *